US011358164B2

(12) United States Patent
Fan et al.

(10) Patent No.: US 11,358,164 B2
(45) Date of Patent: Jun. 14, 2022

(54) WATER OUTLET MECHANISM AND SHOWER HEAD COMPRISING THE WATER OUTLET MECHANISM

(71) Applicant: Xiamen Solex High-Tech Industries Co., Ltd., Xiamen (CN)

(72) Inventors: Qihua Fan, Xiamen (CN); Shilong Wu, Xiamen (CN); Fengde Lin, Xiamen (CN); Wenxing Chen, Xiamen (CN)

(73) Assignee: Xiamen Solex High-Tech Industries Co., Ltd., Xiamen (CN)

( * ) Notice: Subject to any disclaimer, the term of this patent is extended or adjusted under 35 U.S.C. 154(b) by 246 days.

(21) Appl. No.: 16/730,980

(22) Filed: Dec. 30, 2019

(65) Prior Publication Data

US 2020/0206761 A1 Jul. 2, 2020

(30) Foreign Application Priority Data

Dec. 29, 2018 (CN) ..... 201811646334.0

(51) Int. Cl.
*B05B 7/04* (2006.01)
*B05B 1/18* (2006.01)
*E03C 1/084* (2006.01)

(52) U.S. Cl.
CPC ..... *B05B 7/0425* (2013.01); *B05B 1/185* (2013.01); *E03C 1/084* (2013.01)

(58) Field of Classification Search
CPC ..... B05B 1/18; B05B 1/185; B05B 7/005; B05B 7/0425; E03C 1/084
See application file for complete search history.

(56) References Cited

U.S. PATENT DOCUMENTS 7,946,512 B2 * 5/2011 Schorn ..... B05B 3/0422 239/428.5
9,884,332 B2 * 2/2018 Zhou ..... B05B 7/0425
2011/0240767 A1 * 10/2011 Kitaura ..... E03C 1/084 239/428.5
2012/0175438 A1 * 7/2012 Ji ..... B05B 1/08 239/601
2013/0320113 A1 * 12/2013 Ji ..... B05B 7/0425 239/428.5

FOREIGN PATENT DOCUMENTS

CN 102366738 A 3/2012

* cited by examiner

*Primary Examiner* — Darren W Gorman
(74) *Attorney, Agent, or Firm* — Cooper Legal Group, LLC

(57) ABSTRACT

The present disclosure discloses a water outlet mechanism and a shower head comprising the water outlet mechanism. The water outlet mechanism comprises an inlet, an air intake chamber, an air intake passage, and a water outlet passage. The water outlet passage is in communication with the air intake chamber, and the air intake chamber is disposed with a wall connected to an entrance of the water outlet passage. The water outlet passage gradually increases in a downward direction, and a plurality of rectifying ribs protrude from an inner wall of the water outlet passage and are arranged in a circumferential direction at intervals. When the water flows through the inlet and enters the air intake chamber, a flowing cross sectional area of the water changes suddenly, an air pressure surrounding the water is less than the external air pressure, and a negative pressure is generated in the air intake chamber.

20 Claims, 8 Drawing Sheets

WATER OUTLET MECHANISM AND SHOWER HEAD COMPRISING THE WATER OUTLET MECHANISM

RELATED APPLICATIONS

This application claims priority to Chinese Patent Application 201811646334.0, filed on Dec. 29, 2018. Chinese Patent Application 201811646334.0 is incorporated herein by reference.

FIELD OF THE DISCLOSURE

The present disclosure relates to bathroom fixtures, in particular to a water outlet mechanism and shower head comprising the water outlet mechanism.

BACKGROUND OF THE DISCLOSURE

Existing water outlet mechanisms, such as the air-intake and focused-type sprayer apparatus described in CN102366738B, comprise a convergence chamber having, along an axial direction thereof, a large end and a small end. An inner wall between the large end and the small end gradually tapers. At least two water inlets are in communication with the large end of the convergence chamber, and all of the water inlets converge within the convergence chamber towards a water discharging direction of the convergence chamber. At least one air intake passage is in communication with the convergence chamber from an external open space. A rectifier opening is in communication with the small end of the convergence chamber, and the rectifier opening is provided with a throat for allowing water flow to form a liquid seal. A cross sectional area of the throat is one to three times greater in size than a maximum total cross sectional area of the water inlet. The rectifier opening gradually increases outwards in the cross sectional size thereof from the throat, and the flow expansion range is limited.

BRIEF SUMMARY OF THE DISCLOSURE

The present disclosure provides a water outlet mechanism and a shower head comprising the water outlet mechanism to solve deficiencies of the water outlet mechanism of the existing techniques.

In order to solve the aforementioned technical problems, a first technical solution of the present disclosure is as follows.

A water outlet mechanism comprising an inlet, an air intake chamber in communication with the inlet, an air intake passage, and a water outlet passage. The water outlet passage is in communication with the air intake chamber, and the air intake chamber is disposed with a wall connected to an entrance of the water outlet passage. The water outlet passage gradually increases in a downward direction, and a plurality of rectifying ribs protrude from an inner wall of the water outlet passage and are arranged in a circumferential direction at intervals.

In a preferred embodiment, the wall gradually decreases from a top of the wall to the entrance of the water outlet passage.

In a preferred embodiment, the inner wall of the water outlet passage defines a second conical wall structure, and an upper end of the second conical wall structure is smaller than a lower end of the second conical wall structure.

In a preferred embodiment, the plurality of rectifying ribs are disposed in an annular array about an axis of the second conical wall structure.

In a preferred embodiment, a length of each of the plurality of rectifying ribs is equal to a length of the second conical wall structure.

In a preferred embodiment, a width of each of the plurality of rectifying ribs decreases gradually in a direction from the inner wall of the water outlet passage to an end of each of the plurality of rectifying ribs.

In a preferred embodiment, the wall defines a first conical wall structure, and an upper end of the first conical wall structure is larger than a lower end of the first conical wall structure.

In a preferred embodiment, the air intake chamber is disposed with a cylindrical wall connected to the wall, and an axis of the cylindrical wall and an axis of the first conical wall structure are coaxial.

In a preferred embodiment, the air intake chamber is disposed with a spherical surface surrounding a water outlet of the inlet, and water flowing out from the water outlet of the inlet flows along the spherical surface.

In a preferred embodiment, the plurality of rectifying ribs partially block the entrance of the water outlet passage.

In a preferred embodiment, the water outlet mechanism comprises a water outlet seat and a jet device. The water outlet seat is connected to the jet device. The jet device is disposed with the inlet, and the water outlet seat is disposed with the air inlet passage, the wall and the water outlet passage.

In a preferred embodiment, the water outlet seat is disposed with a through hole. The wall and the water outlet passage define the through hole. An upper end of the through hole is disposed with an enlarged hole, and the enlarged hole is disposed with an annular step surface. An inner port of the air intake passage is disposed on the annular step surface, and an outer port of the air intake passage is disposed on an outer wall or a bottom wall of the water outlet seat.

In a preferred embodiment, a bottom of the jet device is disposed with a groove, and the water outlet seat is fixedly disposed in the groove. A bottom of the groove is disposed with the inlet leading to a top of the jet device.

In a preferred embodiment, the bottom of the groove comprises a spherical surface having a downward opening and an annular surface connected to a periphery of the spherical surface.

A second technical solution of the present disclosure is as follows:

A water outlet mechanism comprises a water outlet seat and a jet device. The water outlet seat is connected to the jet device, and the jet device is disposed with an inlet. The water outlet seat and the jet device cooperate to define an air intake chamber in communication with the inlet. The water outlet seat is disposed with an air intake passage, and the water outlet seat is disposed with a through hole. A wall and a water outlet passage define the through hole, and an inner space of the wall defines the air intake chamber or a part of the air intake chamber. The water outlet passage gradually increases in a downward direction, and when water flows into the air intake chamber through the inlet, external air is sucked into the air intake chamber through the air intake passage.

In a preferred embodiment, the wall gradually decreases from a top of the wall to an entrance of the water outlet passage.

In a preferred embodiment, an upper end of the through hole is disposed with an enlarged hole, and the enlarged hole is disposed with an annular step surface. An inner port of the air intake passage is disposed on the annular step surface, and an outer port of the air intake passage is disposed on an outer wall or a bottom wall of the water outlet seat.

In a preferred embodiment, a bottom of the jet device is disposed with a groove, and the water outlet seat is fixedly disposed in the groove. A bottom of the groove is disposed with the inlet leading to a top of the jet device.

In a preferred embodiment, the bottom of the groove comprises a spherical surface having a downward opening and an annular surface connected to a periphery of the spherical surface.

In a preferred embodiment, a plurality of rectifying ribs partially block the entrance of the water outlet passage.

A third technical solution of the present disclosure is as follows:

A shower head comprising a water outlet mechanism. The shower head comprises an upper shell and a lower shell. The upper shell is disposed with a supply waterway, and the lower shell is disposed with a mounting hole. The mounting hole is disposed with the water outlet mechanism, and the supply waterway is in communication with the inlet of the water outlet mechanism.

Compared with existing techniques, the technical solution of the present disclosure has the following advantages.

When the water flows through the inlet and enters the air intake chamber, a flowing cross sectional area of the water changes suddenly, an air pressure surrounding the water is less than the external air pressure, and a negative pressure is generated in the air intake chamber. Due to the negative pressure, the external air is sucked into the air intake chamber, and the water flows along an inner wall of the air intake chamber. The air and the water oscillate and mix in the air intake chamber to form aerated water. The aerated water is rectified through the plurality of rectifying ribs and sprays out from the water outlet passage. Due to the Coanda effect, the water is enlarged gradually along the water outlet passage. Therefore, the technical problems of the existing techniques are overcome and the technical effects are as follows: the at least two rectifying ribs block and pierce the water to achieve the rectification; moreover, the at least two rectifying ribs enlarge the Coanda effect to achieve a larger range of spraying.

The inner wall of the water outlet passage defines a second conical wall structure and an upper end of the second conical wall structure is smaller than a lower end of the second conical wall structure. Therefore, the Coanda effect is better.

A length of each of the plurality of rectifying ribs is equal to a length of the second conical wall structure, and therefore the rectifying effect is better.

A width of each of the plurality of rectifying ribs decreases gradually in a direction from the inner wall of the water outlet passage to an end of each of the plurality of rectifying ribs, and therefore the rectifying effect is better.

The wall defines a first conical wall structure, and an upper end of the first conical wall structure is larger than a lower end of the first conical wall structure. Therefore, the ability of the water outlet mechanism to create vibration is increased.

The jet device is disposed with the inlet, and the water outlet seat is disposed with the air intake passage, the wall and the water outlet passage. Therefore, assembly of the water outlet mechanism is easy.

The water outlet seat is disposed with a through hole defined by the wall and the water outlet passage. An inner port of the air intake passage is disposed on an annular step surface of the through hole. Therefore, the layout is reasonable, the structure is compact, and the air-water mixing effect is good.

The air intake chamber is disposed with a spherical surface surrounding a water outlet of the inlet, and water flowing out from the water outlet of the inlet flows along the spherical surface. Therefore, due to irregular change in the water pattern caused by the spherical surface, water flow varies, resulting in the water flow having a massage effect.

The water outlet mechanism comprises a water outlet seat and a jet device. The jet device is disposed with an inlet, and the water outlet seat and the jet device cooperate to define an air intake chamber in communication with the inlet. The water outlet seat is disposed with an air intake passage, and the water outlet seat is disposed with a through hole. A wall and a water outlet passage define the through hole, and the wall gradually decreases from a top of the wall to an entrance of the water outlet passage. The water outlet passage gradually increases in a downward direction, and the water flows along an inner wall of the air intake chamber. The air and the water oscillate and mix in the air intake chamber to form aerated water. The aerated water is rectified through the plurality of rectifying ribs and sprays out from the water outlet passage. Due to the Coanda effect, the water is enlarged gradually along the water outlet passage. Moreover, the layout is reasonable, and the structure is compact.

BRIEF DESCRIPTION OF THE DRAWING

The present disclosure will be further described below with the combination of the accompanying drawings together with the embodiments.

In FIG. 9, a single dotted line represents water flow and a double dotted line represents air flow.

DETAILED DESCRIPTION OF THE EMBODIMENTS

Embodiment 1

Figure 1:
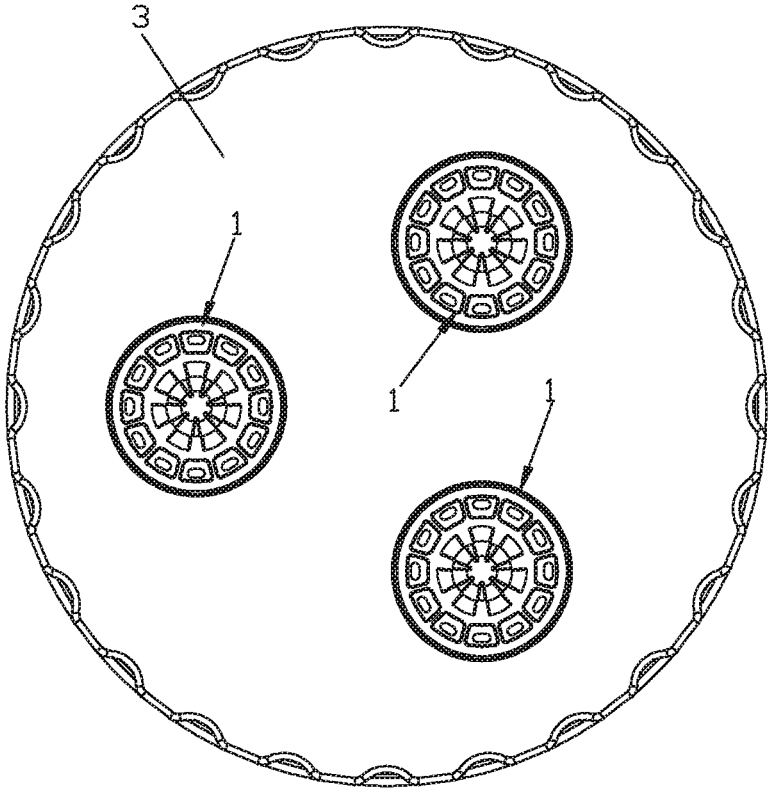
FIG. 1 illustrates a bottom view of a shower head of a first specific embodiment.
Figure 2:
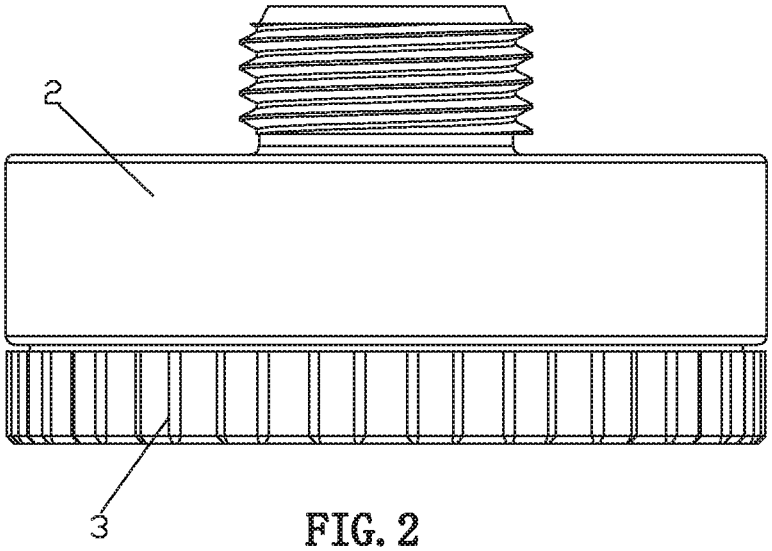
FIG. 2 illustrates a front view of the shower head of the first specific embodiment.
Figure 3:
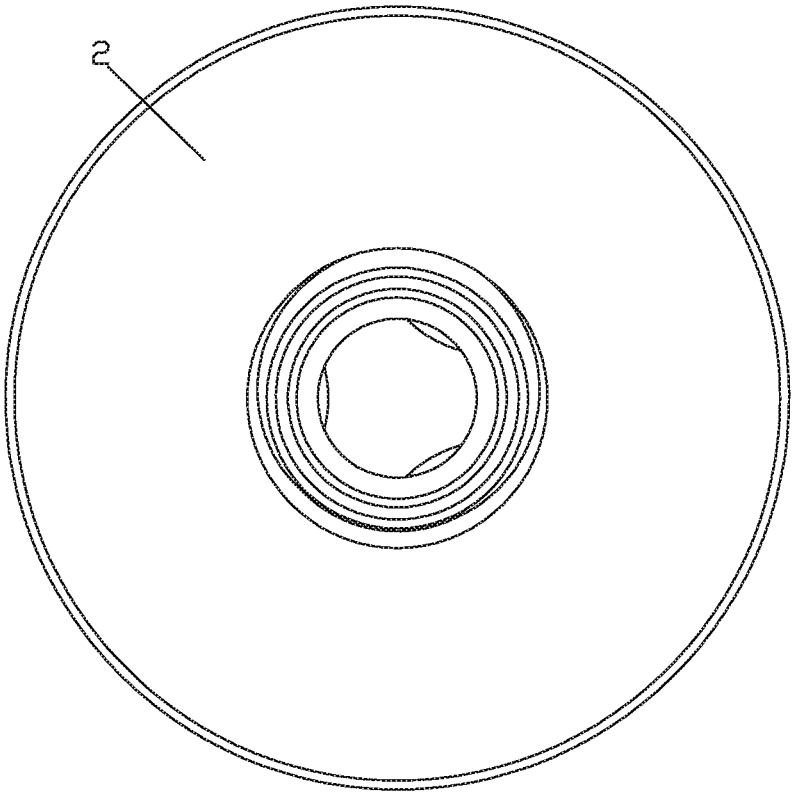
FIG. 3 illustrates a top view of the shower head of the first specific embodiment.
Figure 4:
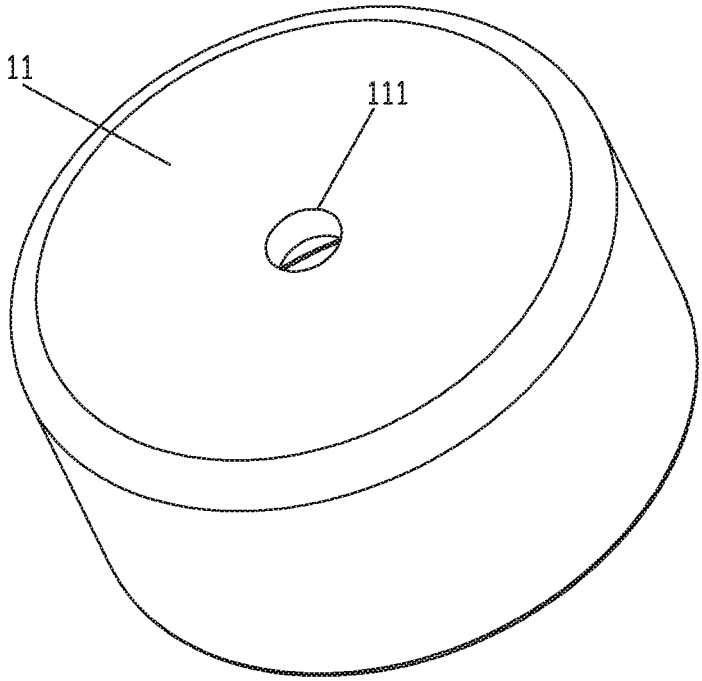
FIG. 4 illustrates a first perspective view of a jet device of the first specific embodiment.
Figure 5:
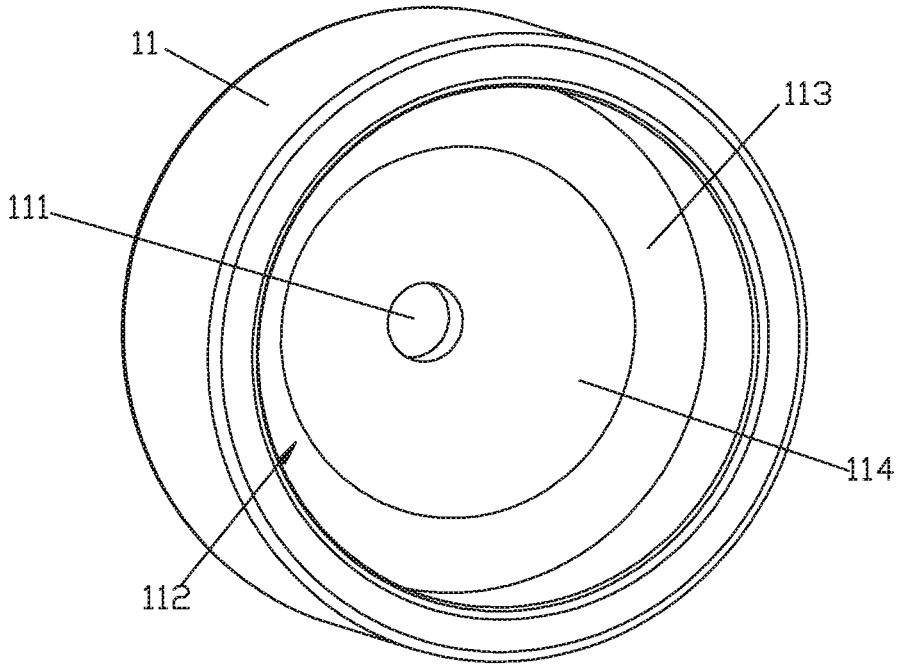
FIG. 5 illustrates a second perspective view of the jet device of the first specific embodiment.
Figure 6:
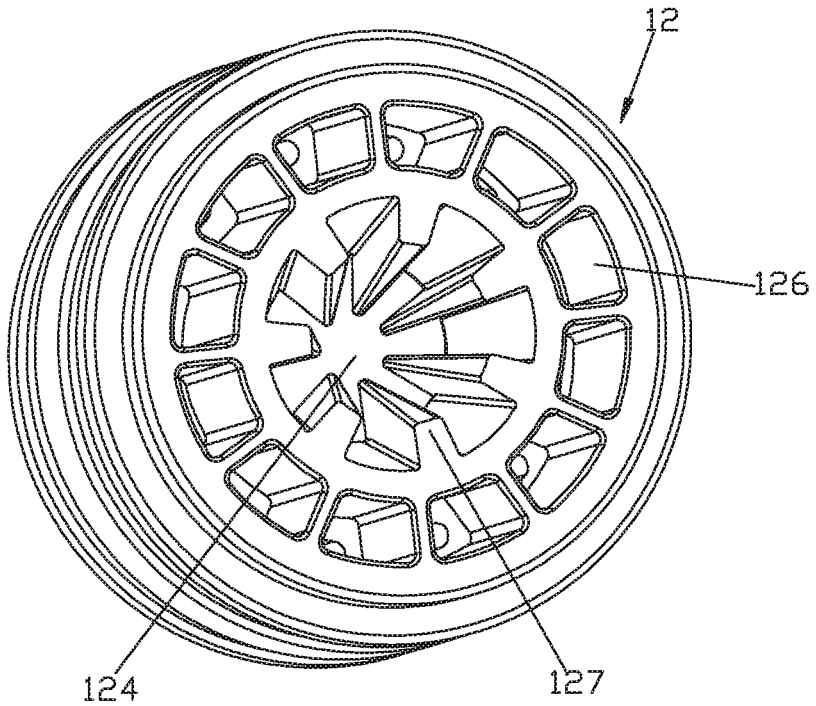
FIG. 6 illustrates a first perspective view of a water outlet seat of the first specific embodiment.
Figure 7:
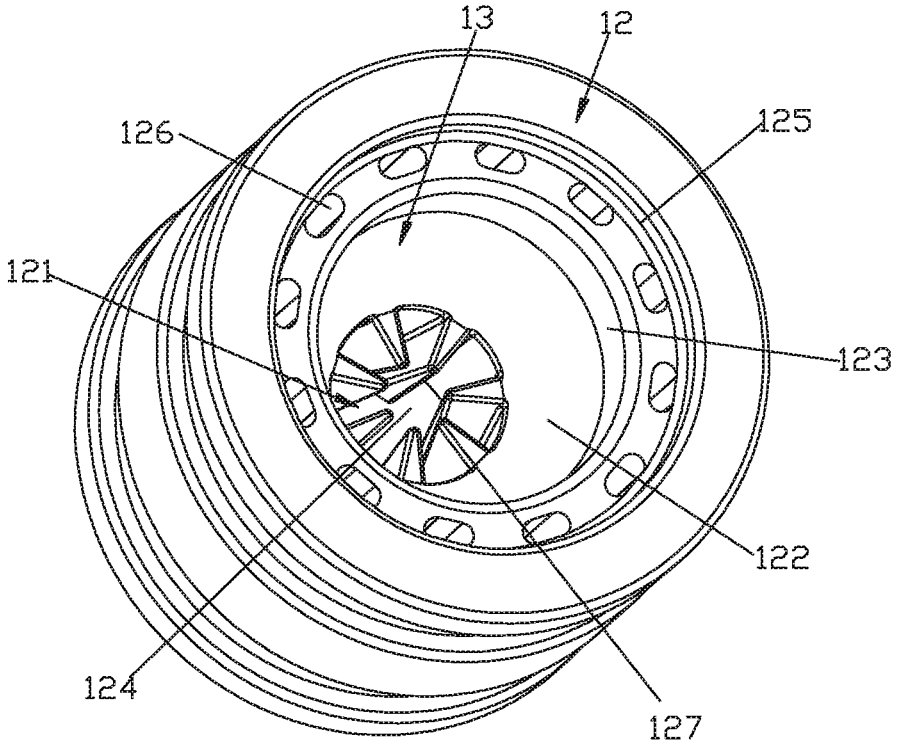
FIG. 7 illustrates a second perspective view of the water outlet seat of the first specific embodiment.
Figure 8:
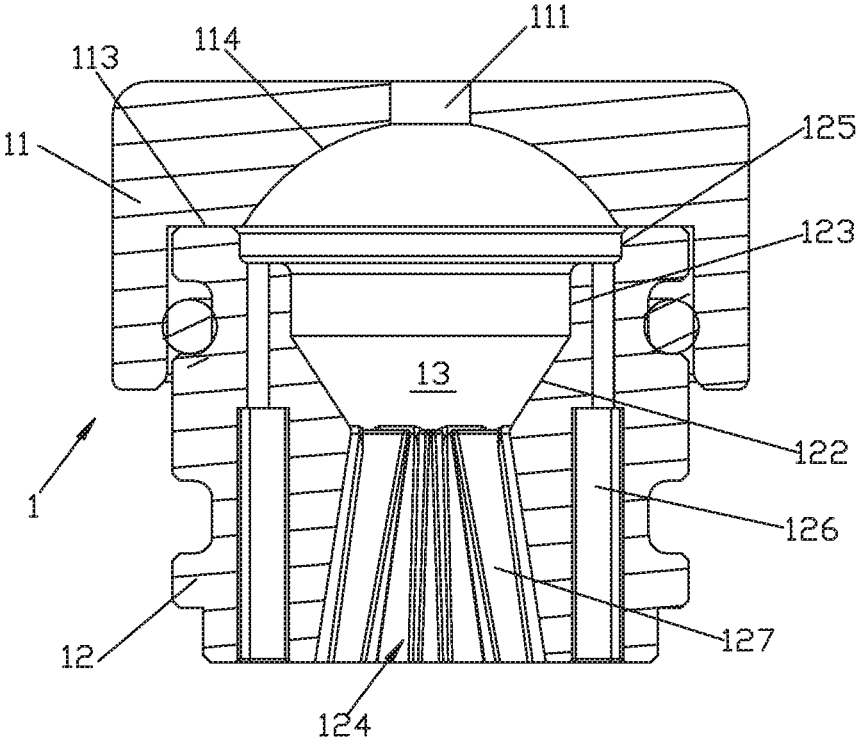
FIG. 8 illustrates a cross sectional view of a water outlet mechanism of the first specific embodiment.
Figure 9:
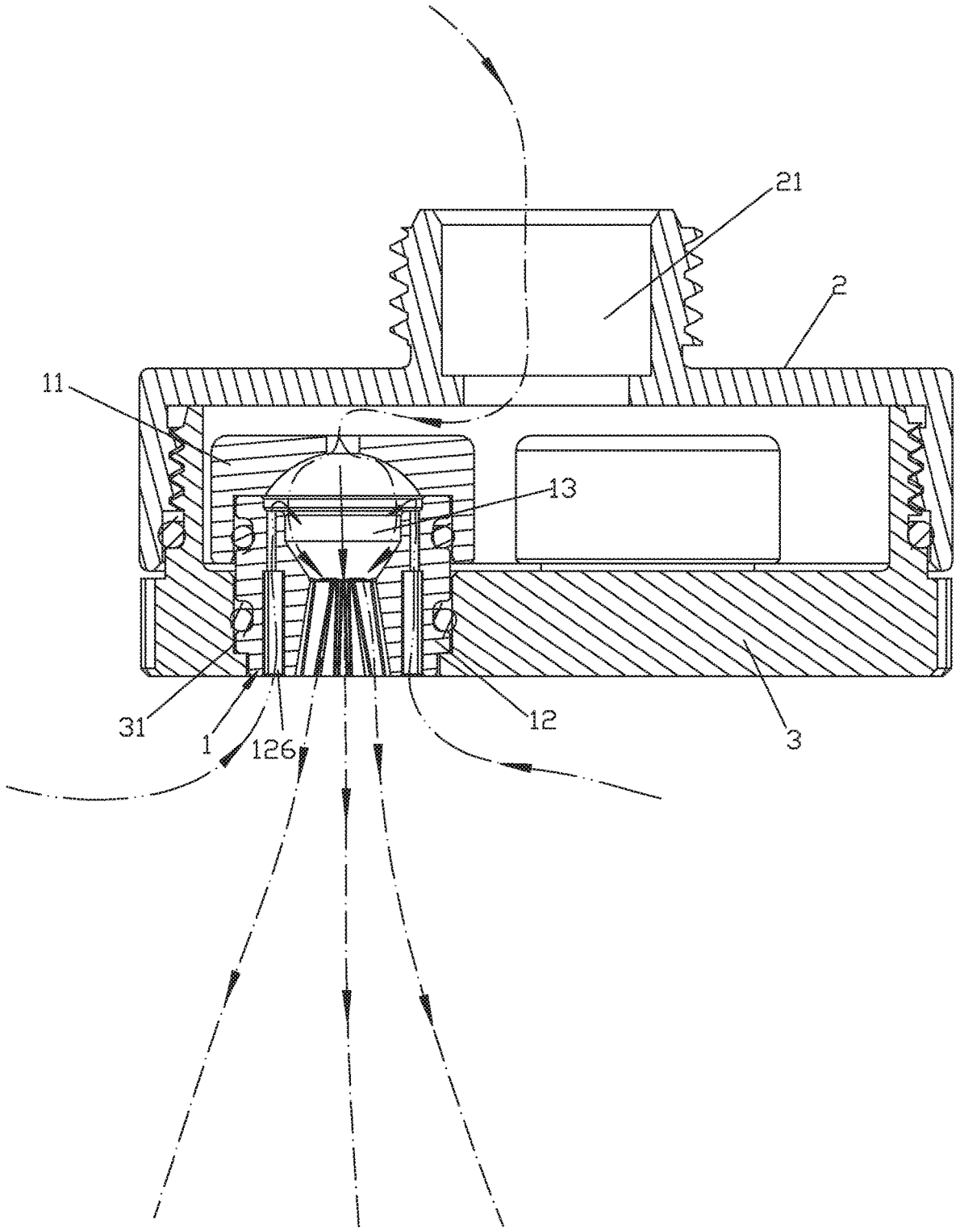
FIG. 9 illustrates a cross sectional view of the shower head of the first specific embodiment.
Figure 10:
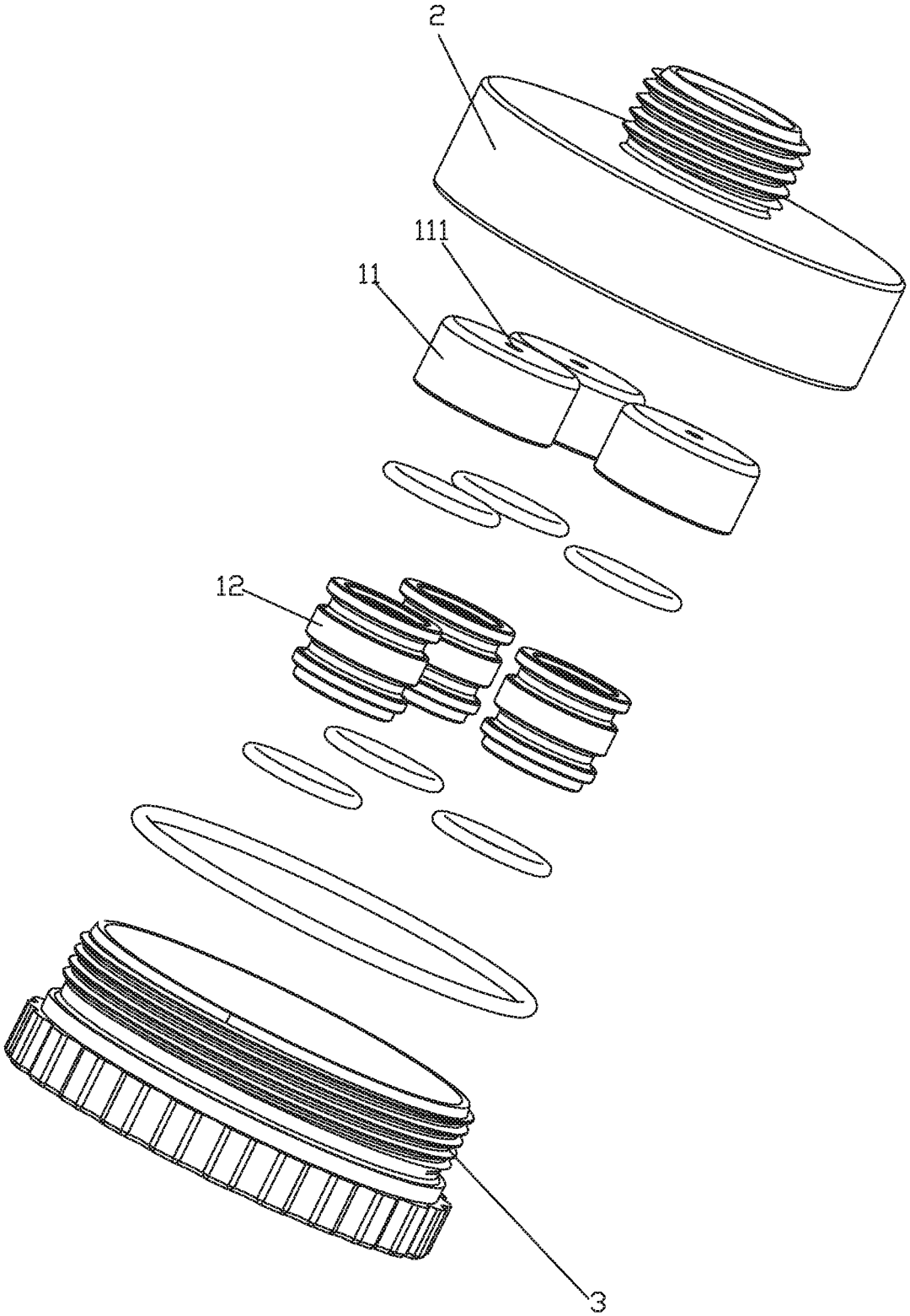
FIG. 10 illustrates an exploded perspective schematic view of the shower head of the first specific embodiment.
Figure 11:
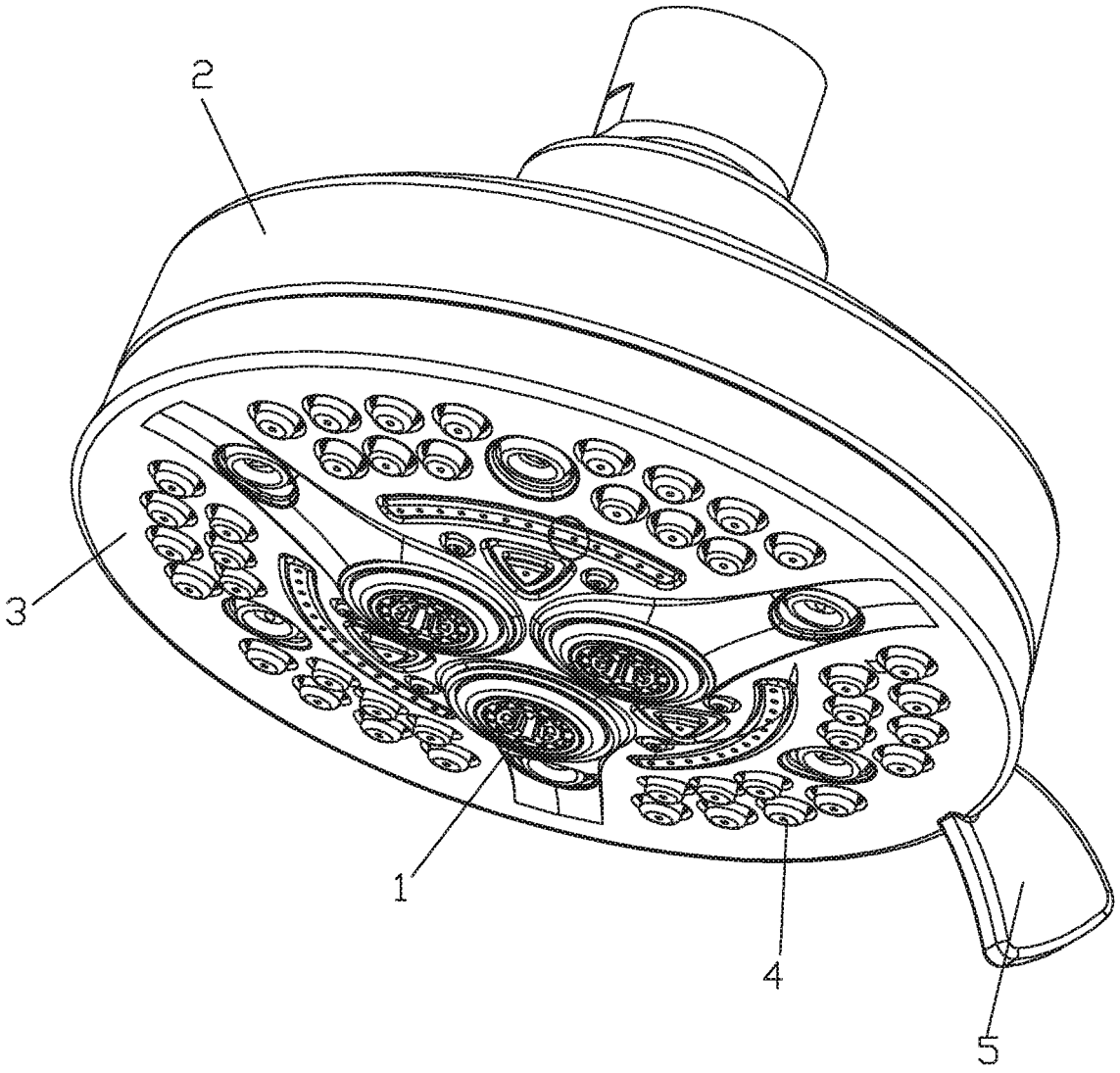
FIG. 11 illustrates a perspective view of a shower head of a second specific embodiment.
Figure 12:
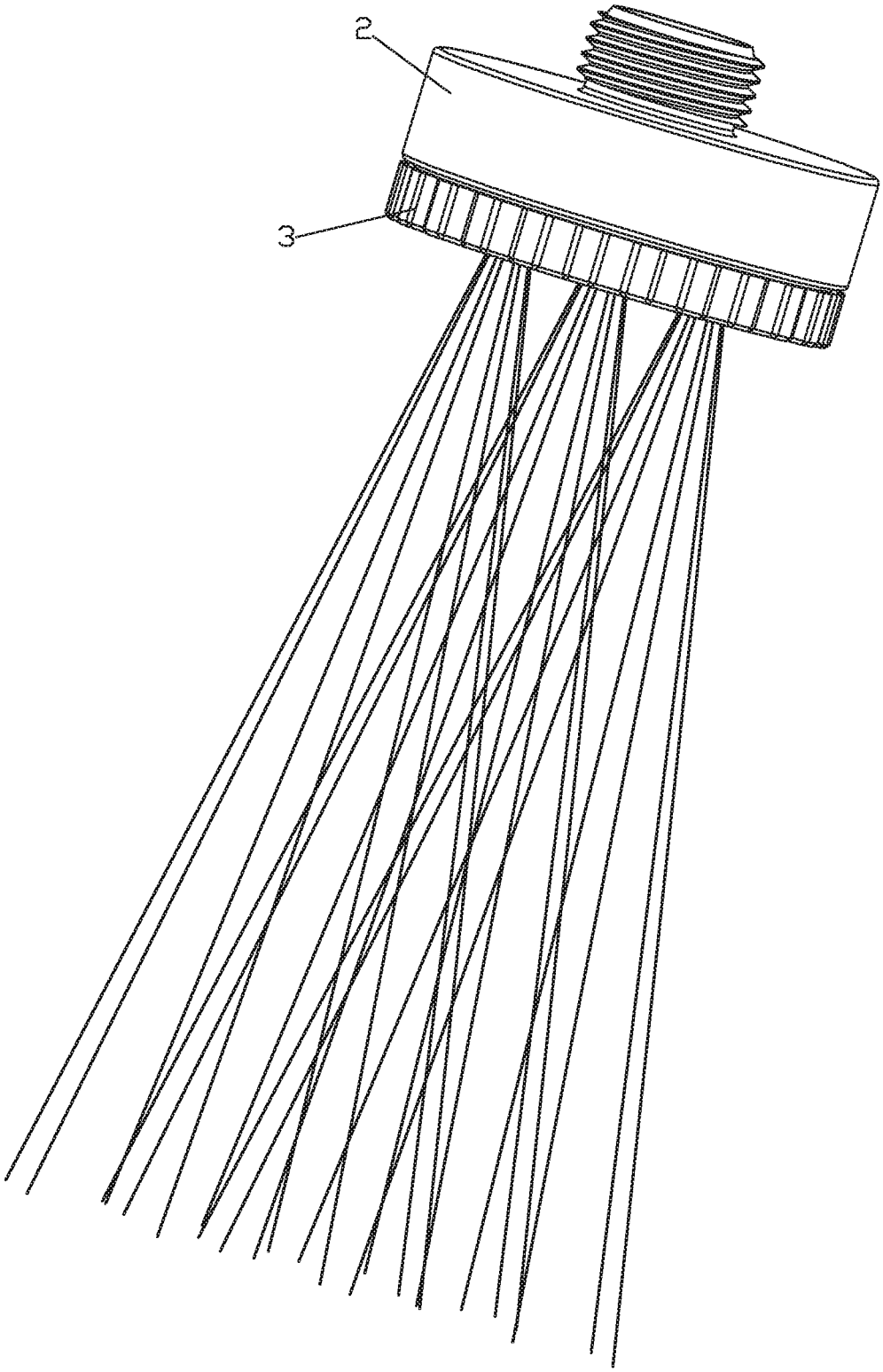
FIG. 12 illustrates a schematic view of the shower head of the second specific embodiment when water flows out from the shower head.

Referring to FIGS. 1-10, a shower head comprises an upper shell 2, a lower shell 3, and a first water outlet mechanism 1. The upper shell 2 is fixedly disposed with the lower shell 3. The upper shell 2 is disposed with a supply waterway 21, and the lower shell 3 is disposed with three through mounting holes 31. Each of the three through mounting holes 31 is disposed with a first water outlet mechanism 1. The supply waterway 21 is in communication with an inlet 111 of the first water outlet mechanism 1. In this specific embodiment, the shower head is disposed with only one water spray pattern, that is, the water outlet spray of the first water outlet mechanism in this specific embodiment. In another specific embodiment, as shown in FIGS. 11 and 12, the shower head can also be disposed with a second water outlet mechanism 4, and a waterway switching mechanism 5 is further disposed to connect the second water outlet mechanism 4 with the first water outlet mechanism 1 of this specific embodiment so that the waterway switching mechanism 5 can switch between the second water outlet mechanism 4 and the first water outlet mechanism 1 of this specific embodiment.

The first water outlet mechanism 1 comprises a water outlet seat 12 and a jet device 11. The water outlet seat 12 is connected to the jet device 11. For example, a connection between the water outlet seat 12 and the jet device 11 is a fixed sealing connection.

The jet device 11 is disposed with the inlet 111. In an embodiment, a bottom of the jet device 11 is disposed with a groove 112. A bottom of the groove 112 comprises a spherical surface 114 having a downward opening and an annular surface 113 connected to a periphery of the spherical surface 114, and a center of the spherical surface 114 is disposed with the inlet 111 connected to a top of the jet device 11. A groove wall of the groove 112 comprises a first cylindrical wall extending downward from a periphery of the annular surface 113.

The water outlet seat 12 is fixedly disposed in the groove 112. In an embodiment, an outer wall of the water outlet seat 12 is coupled to an inner wall of the first cylindrical wall to fixedly connect the water outlet seat 12 and the jet device 11. The water outlet seat 12 is inserted into the groove 112, and a sealing ring is disposed between the water outlet seat 12 and the first cylindrical wall of the groove 112.

The water outlet seat 12 is disposed with a through hole 121. The through hole 121 comprises a wall 122, a second cylindrical wall 123, and a water outlet passage 124. A periphery of the wall 122 extends upward to define the second cylindrical wall 123. A top end of the through hole 121 is disposed with an enlarged hole 125, and the enlarged hole 125 comprises an annular step surface. The water outlet seat 12 is disposed with at least one air intake passage 126. An inner port of each of the at least one air intake passage 126 is disposed on the annular step surface, and an outer port of each of the at least one air intake passage 126 is disposed on a bottom wall of the water outlet seat 12. In the present specific embodiment, an upper end surface of the water outlet seat 12 abuts the annular surface 113 of the groove 112.

In the present specific embodiment, a space between the wall 122 of the through hole 121, the second cylindrical wall 123, an inner wall of the enlarged hole 125, and the spherical surface 114 defines an air intake chamber 13. Moreover, the wall 122 gradually decreases from an upper end to an entrance of the water outlet passage 124, and the water outlet passage 124 gradually increases from a top end to a bottom end. In one embodiment, an inner wall of the water outlet passage 124 comprises a second conical wall structure, and an upper end of the second conical wall structure is smaller than a lower end of the second conical wall structure. The wall 122 comprises a first conical wall structure, and an upper end of the first conical wall structure is larger than a lower end of the first conical wall structure. An axis of the water outlet passage 124, an axis of the wall 122 and an axis of the second cylindrical wall 123 are coaxial. The tapering, or gradual decreasing, of the wall may result in the wall 122 having a regular shape or an irregular shape. For example, an inner wall of the wall 122 can be selected from a linear structure, a curved structure, or a multi-fold line structure. An inner diameter of the second cylindrical wall 123 is far larger than an inner diameter of a lower port of the inlet 111. When water flows from the inlet 111 into the air intake chamber 13, a negative pressure is generated, and external air is sucked into the air intake chamber 13 through the at least one air intake passage 126 due to the negative pressure. The air and the water cooperate to form aerated water.

In the present specific embodiment, the inner wall of the water outlet passage 124 protrudes to define at least two rectifying ribs 127 arranged in a circumferential direction at intervals. For example, the at least two rectifying ribs 127 are disposed in an annular array. As required, the annular array can be a circular shape, a square shape, or other regular or irregular shape. A length of each of the at least two rectifying ribs 127 is equal to a length of the second conical wall structure of the water outlet passage 124. A width of each of the at least two rectifying ribs 127 decreases gradually in a direction from the inner wall of the water outlet passage 124 to an end of each of the at least two rectifying ribs 127. In the present specific embodiment, a cross sectional area of each of the at least two rectifying ribs 127 defines a trapezoidal structure. A top of each of the at least two rectifying ribs 127 is aligned with the entrance of the water outlet passage 124, and a bottom of each of the at least two rectifying ribs 127 is aligned with an outlet of the water outlet passage 124. A height of each of the at least two rectifying ribs 127 is smaller than a radius of the entrance of the water outlet passage 124. In a preferred embodiment, the bottom or the top of each of the at least two rectifying ribs 127 is respectively retracted relative to the outlet or the entrance of the water outlet passage 124. In a preferred embodiment, a layout of a position of each of the at least two rectifying ribs 127 can be designed as required as long as the at least two rectifying ribs 127 will not completely block flowing water. In a preferred embodiment, an axis of each of the at least two rectifying ribs 127 disposed in a circumferential direction may also be partially disposed with a central axis of the water outlet passage 124 at an angle, and each of the at least two rectifying ribs 127 defines a straight line that is not in a plane with the central axis of the water outlet passage 124.

In the present specific embodiment, when the water flows through the inlet 111 and enters the air intake chamber 13, a flowing cross sectional area of the water changes suddenly, an air pressure surrounding the water is less than the external air pressure, and a negative pressure is generated in the air intake chamber 13. Due to the negative pressure, the external air is sucked into the air intake chamber 13, and the water sprays along an inner wall of the air intake chamber 13. The air and the water oscillate and mix in the air intake chamber 13 to form aerated water. The aerated water is rectified through the at least two rectifying ribs 127 and sprays out from the water outlet passage 124. Due to the Coanda effect, the water is enlarged gradually along the second conical wall structure of the water outlet passage 124. With the at least two rectifying ribs 127, when the water flows from the inlet 111 into the air intake chamber 13, the air and the water mix and form bubbles of different sizes. The at least two rectifying ribs 127 partially block the entrance of the water outlet passage 124 and play a role of a rectifier. The at least two rectifying ribs 127 rectify the bubbles of different sizes into bubbles of uniform size. The bubbles of uniform size, after rectification, make the Coanda effect stronger and achieve a larger range of spraying, i.e. the at least two rectifying ribs 127 block and pierce the water to achieve the rectification; moreover, the at least two rectifying ribs 127 enlarge the Coanda effect to achieve the larger range of spraying. A water outlet of the water outlet mechanism is larger, the appearance is unique, and the identification of the water outlet mechanism is easy. Because of an air intake effect of the water outlet mechanism, an impact force is greater than that of the ordinary non-air intaking components. The spherical surface 114 and the wall 122 make the water flowing out from the jet device oscillate in the air intake chamber 13, so that the water has a certain impulse sense and a shower feeling is better.

It will be apparent to those skilled in the art that various modifications and variation can be made in the present disclosure without departing from the spirit or scope of the invention. Thus, it is intended that the present disclosure cover the modifications and variations of this invention provided they come within the scope of the appended claims and their equivalents.

What is claimed is:

1. A water outlet mechanism, comprising:
an inlet,
an air intake chamber in communication with the inlet,
an air intake passage, and
a water outlet passage, wherein:
the water outlet passage is in communication with the air intake chamber,
the air intake chamber is disposed with a first wall connected to an entrance of the water outlet passage,
the water outlet passage gradually increases in diameter in a downward direction,
a plurality of rectifying ribs protrude from an inner wall of the water outlet passage and are arranged in a circumferential direction at intervals, and
the plurality of rectifying ribs partially block the entrance of the water outlet passage.

2. The water outlet mechanism according to claim 1, wherein the first wall gradually decreases in diameter from a top of the first wall to the entrance of the water outlet passage.

3. The water outlet mechanism according to claim 1, wherein:
the inner wall of the water outlet passage defines a first conical wall structure, and
an upper end of the first conical wall structure is smaller than a lower end of the first conical wall structure.

4. The water outlet mechanism according to claim 3, wherein:
the plurality of rectifying ribs are disposed in an annular array about an axis of the first conical wall structure.

5. The water outlet mechanism according to claim 3, wherein a length of each of the plurality of rectifying ribs is equal to a length of the first conical wall structure.

6. The water outlet mechanism according to claim 3, wherein a width of each of the plurality of rectifying ribs decreases gradually in a direction from the inner wall of the water outlet passage to an end of each of the plurality of rectifying ribs.

7. The water outlet mechanism according to claim 2, wherein:
the first wall defines a first conical wall structure, and
an upper end of the first conical wall structure is larger than a lower end of the first conical wall structure.

8. The water outlet mechanism according to claim 7, wherein:
the air intake chamber is disposed with a cylindrical wall connected to the first wall, and
an axis of the cylindrical wall and an axis of the first conical wall structure are coaxial.

9. The water outlet mechanism according to claim 1, wherein:
the air intake chamber is disposed with a spherical surface surrounding a water outlet of the inlet, and
water flowing out from the water outlet of the inlet flows along the spherical surface.

10. The water outlet mechanism according to claim 1, comprising:
a water outlet seat, and
a jet device, wherein:
the water outlet seat is connected to the jet device,
the jet device is disposed with the inlet, and
the water outlet seat is disposed with the air intake passage, the first wall, and the water outlet passage.

11. The water outlet mechanism according to claim 10, wherein:
the water outlet seat is disposed with a through hole,
the first wall and the water outlet passage define the through hole,
an upper end of the through hole is disposed with an enlarged hole,
the enlarged hole is disposed with an annular step surface,
an inner port of the air intake passage is disposed on the annular step surface, and
an outer port of the air intake passage is disposed on an outer wall or a bottom wall of the water outlet seat.

12. The water outlet mechanism according to claim 10, wherein:
a bottom of the jet device is disposed with a groove,
the water outlet seat is fixedly disposed in the groove, and
a bottom of the groove is disposed with the inlet leading to a top of the jet device.

13. The water outlet mechanism according to claim 12, wherein the bottom of the groove comprises a spherical surface having a downward opening and an annular surface connected to a periphery of the spherical surface.

14. A water outlet mechanism, comprising:
a water outlet seat, and
a jet device, wherein:
a bottom of the jet device is disposed with a groove,
the water outlet seat is fixedly disposed in the groove,
a bottom of the groove is disposed with an inlet leading to a top of the jet device,
the water outlet seat and the jet device cooperate to define an air intake chamber in communication with the inlet,
the water outlet seat is disposed with an air intake passage,
the water outlet seat is disposed with a through hole,
a wall and a water outlet passage define the through hole,
an inner space of the wall defines the air intake chamber or a part of the air intake chamber, the water outlet passage gradually increases in diameter in a downward direction, and when water flows into the air intake chamber through the inlet, external air is sucked into the air intake chamber through the air intake passage.

15. The water outlet mechanism according to claim 14, wherein the wall gradually decreases in diameter from a top of the wall to an entrance of the water outlet passage.

16. The water outlet mechanism according to claim 14, wherein:

an upper end of the through hole is disposed with an enlarged hole, the enlarged hole is disposed with an annular step surface, an inner port of the air intake passage is disposed on the annular step surface, and an outer port of the air intake passage is disposed on an outer wall or a bottom wall of the water outlet seat.

17. The water outlet mechanism according to claim 14, wherein the bottom of the groove comprises a spherical surface having a downward opening and an annular surface connected to a periphery of the spherical surface.

18. The water outlet mechanism according to claim 14, wherein a plurality of rectifying ribs partially block an entrance of the water outlet passage.

19. A shower head comprising the water outlet mechanism of claim 1, comprising:

an upper shell, and a lower shell, wherein:

the upper shell is disposed with a supply waterway, the lower shell is disposed with a mounting hole, the mounting hole is disposed with the water outlet mechanism, and the supply waterway is in communication with the inlet of the water outlet mechanism.

20. A water outlet mechanism, comprising:

an inlet, an air intake chamber in communication with the inlet, an air intake passage, and a water outlet passage, wherein:

the water outlet passage is in communication with the air intake chamber, the air intake chamber is disposed with a first wall connected to an entrance of the water outlet passage, the water outlet passage gradually increases in diameter in a downward direction, a plurality of rectifying ribs protrude from an inner wall of the water outlet passage and are arranged in a circumferential direction at intervals, the air intake chamber is disposed with a spherical surface surrounding a water outlet of the inlet, and water flowing out from the water outlet of the inlet flows along the spherical surface.

* * * * *